US012150537B2

(12) United States Patent
Lee

(10) Patent No.: US 12,150,537 B2
(45) Date of Patent: Nov. 26, 2024

(54) COSMETIC CASE HAVING REFILL STRUCTURE

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 316 days.

(21) Appl. No.: 17/956,604

(22) Filed: Sep. 29, 2022

(65) Prior Publication Data

US 2023/0117210 A1 Apr. 20, 2023

(30) Foreign Application Priority Data

Oct. 14, 2021 (KR) ..... 10-2021-0136629

(51) Int. Cl.
*A45D 34/04* (2006.01)

(52) U.S. Cl.
CPC ..... *A45D 34/04* (2013.01); *A45D 2200/05* (2013.01); *A45D 2200/057* (2013.01)

(58) Field of Classification Search
CPC ..... A45D 34/04; A45D 2200/05; A45D 2200/057; A45D 2034/005; A45D 2200/056; A45D 34/00; B05B 11/0027; B05B 11/1059; B05B 11/106; B65D 83/22
See application file for complete search history.

(56) References Cited

U.S. PATENT DOCUMENTS 10,195,625 B2 * 2/2019 Lee ..... B65D 81/3222

FOREIGN PATENT DOCUMENTS

KR 10-1267966 B1 5/2013

* cited by examiner

*Primary Examiner* — Donnell A Long
(74) *Attorney, Agent, or Firm* — Heedong Chae; Lucem, PC

(57) ABSTRACT

Disclosed is a cosmetic case having a refill structure including: a container body having one opened side and formed with an elevation spiral groove; an outer cap rotatably coupled to the container body and formed with an elevation straight groove; an elevation mechanism elevated in the container body while being rotated with the outer cap and formed with an elevation protrusion; a content container accommodated inside the container body to store contents; a discharging mechanism installed in the content container to discharge the contents; an inner cap coupled to one side of the content container and elevated with the elevation mechanism; and an operation button connected to the discharging mechanism to discharge the contents, wherein the elevation mechanism and the inner cap are formed with a fastening protrusion and a fastening groove and formed with a refill guide groove and a refill guide protrusion, respectively.

14 Claims, 9 Drawing Sheets

COSMETIC CASE HAVING REFILL STRUCTURE

CROSS REFERENCE TO RELATED APPLICATION

The present application claims priority to Korean Patent Application No. 10-2021-0136629, filed on Oct. 14, 2021, the entire contents of which is incorporated herein for all purposes by this reference.

BACKGROUND OF THE INVENTION

1. Field of the Invention

The present invention relates to a cosmetic case having a refill structure, and more particularly, to a cosmetic case having a refill structure in which a content container, a discharging mechanism, an inner cap, and an operation button are moved up and down from a container body by rotating an outer cap so as to be used or replaced conveniently.

2. Description of the Related Art

In today's modern society, both men and women of all ages use cosmetics upon needs in accordance with the rapid diversification trend of the times. In particular, women use cosmetic products and cosmetic tools with various types and various colors, and various high-quality cosmetic products and tools are being released into the market everyday through the research and development of cosmetics-related companies.

According to the purpose of use, the cosmetics are classified into, for example, facial cleansing cosmetics used for removing sebum, wastes and contaminants on a surface of a skin, base cosmetics used for properly supplying moisture and oil to the skin, color cosmetics used for expressing beautiful colors, hair cosmetics used for protecting hairs and supplying nutrition as well as removing foreign substances from hairs or scalp, and perfumes obtained by dissolving fragrant materials in alcohol or the like and used for giving a fragrance to others.

In addition, the cosmetics are manufactured from natural raw materials as interest in the stability of cosmetic compositions and the skin beauty are increased due to the improvement of living standards. However, since preservatives are not added to the above cosmetics to minimize irritation to the skin, the risk of deterioration is relatively high compared to cosmetics manufactured from chemical raw materials. For example, the cosmetics manufactured from natural raw materials may be contaminated or deteriorated when bacteria permeate due to contact with external air during use or the composition is oxidized due to contact with air.

In addition, a container having a simple opening and closing function is generally used in order to store and use cosmetics in a liquid or gel form, such as lotions, creams, gels, shampoos, and hair conditioners, among the above cosmetics. The cosmetics are put from the container by using a spatula or a finger and applied to the skin or hair. However, the above conventional container fails to constantly control the amount of discharged cosmetics, and thus the cosmetics are wasted.

Accordingly, a pump-type cosmetic container minimized in contact between cosmetics and outside air and conveniently used to constantly control the discharge amount of cosmetics has been developed.

The pump-type cosmetic container includes: a container body configured to accommodate contents; a pressurized pump provided in an opening of the container body and operated by pressing; and a nozzle head coupled to an upper portion of the container body while being connected to the pressurized pump, wherein the contents accommodated in the container body are discharged to the outside by a predetermined amount by the pumping operation of the pressurized pump when the nozzle head exposed to the outside is pressed downward.

According to the above-described pump-type cosmetic container, the contents accommodated in the container body is prevented from coming into contact with outside air, it is economical because the contents are not excessively discharged through a discharge port of the nozzle, and it is convenient to use because the cosmetic container operates even when the container body is placed on the floor.

However, according to the conventional cosmetic container, the push button is unintentionally pressed due to the user's carelessness when being stored or carried, and the contents accommodated in the container are discharged to the outside. Thus, the relatively expensive cosmetics are wasted and the surroundings become dirty by the discharged contents.

In addition, the conventional cosmetic container is stored or carried in a state in which the discharge port of the push button for discharging the contents to the outside is completely opened. Thus, the container is contaminated when foreign substances are introduced into the opened discharge port, and the contaminated contents are discharged and used, thereby causing the unsanitary conditions.

In order to solve the above mentioned problems, Korean Patent Registration No. 10-1267966 (hereinafter referred to as "related art") discloses an airless pump cosmetic container having a retractable operation button. The above related art is configured such that the operation button of the airless pump appears and disappears after being moved up and down at the upper side of the cosmetic container, and accordingly the operation button is completely inserted into the container to prevent the operation button from protruding to the outside when not in use due to carrying and storage, so as to secure safety by preventing malfunctions due to carelessness and the like, and facilitate the operation through the pumping by protruding the operation button to the outside when in use.

However, because the related art does not have a separate inner refill structure, the entire cosmetic container is required to be discarded after all of the contents stored in the container are used. Accordingly, resources are wasted, and environmental pollution is accelerated due to the discarded containers.

Therefore, it is necessary to develop a cosmetic container for conveniently refilling the inner container containing the contents while preventing the malfunction of operation button and the contamination of contents.

(Patent Document) Korean Patent Registration No. 10-1267966 (Published on May 27, 2013)

SUMMARY OF THE INVENTION

In order to solve the above problems, the present invention provides a cosmetic case having a refill structure in which the content container, the discharging mechanism, the inner cap, and the operation button are simultaneously lifted and lowered from the container body by rotating the outer cap, so as to be conveniently used and safely stored, and easily separate and replace the components lifted together as above from the container body and the outer cap.

In order to achieve the above-mentioned objects, the present invention provides a cosmetic case having a refill structure includes: a container body having one opened side and formed therein with an elevation spiral groove; an outer cap rotatably coupled to the container body in a predetermined section and formed therein with an elevation straight groove; an elevation mechanism lifted and lowered in the container body while being rotated together with the outer cap, and formed therein with an elevation protrusion; a content container accommodated inside the container body to store contents therein; a discharging mechanism installed in the content container to discharge the contents; an inner cap coupled to one side of the content container, and lifted and lowered together with the elevation mechanism; and an operation button connected to the discharging mechanism to discharge the contents to an outside, wherein the elevation mechanism and the inner cap are formed therein with a fastening protrusion and a fastening groove, respectively, so as to be detachably coupled to each other, and formed therein with a refill guide groove and a refill guide protrusion, respectively, so that the refill guide protrusion is inserted into the refill guide groove.

In addition, the container body may be formed therein with a coupling part, in which the coupling part extends from an end of the container body and is inserted into the outer cap, and the coupling part is formed therein with at least one pair of elevation spiral grooves.

In addition, the fastening protrusion may extend by a predetermined section along an inner circumference of the elevation mechanism, and the fastening groove may extend along an outer circumference of the inner cap.

In addition, the fastening protrusion may be formed on both sides thereof with elastic slits for providing elasticity to the fastening protrusion.

In addition, the refill guide groove and the refill guide protrusion may be formed on an inner circumference of the elevation mechanism and an outer circumference of the inner cap, respectively, in a straight line along a direction in which the content container is inserted or separated.

In addition, one end of the refill guide groove may be opened, and guide oblique surfaces for guiding the refill guide protrusion to be inserted may be formed on both sidewalls of the opened portion.

In addition, the guide oblique surface may be inclined at a predetermined angle in an outward direction of the refill guide groove.

In addition, the elevation mechanism may be formed on an outer circumference thereof with a friction protrusion, to generate friction between the elevation mechanism and the container body while coming into close contact with an inner circumference of the container body.

In addition, the content container may be formed therein with an inlet part, in which the inlet part is screw-coupled to the inner cap.

In addition, the discharging mechanism may include a pump for discharging the contents by pumping.

In addition, the inner cap may be formed therein with a guide straight hole, and the operation button may be formed therein with a guide straight protrusion, so as to be fastened to each other.

In addition, the operation button may be formed therein with a nozzle coupling hole, in which a nozzle having a discharge port may be coupled to the nozzle coupling hole.

In addition, the operation button may be formed thereon with a protrusion part, and the outer cap may be formed thereon with a press-prevention step, so that the protrusion part may be seated on an upper end of the press-prevention step when the operation button is inserted into the outer cap.

In addition, the content container, the discharging mechanism, the inner cap and the operation button may be simultaneously separated from the container body and the outer cap, or inserted into inner spaces of the container body and the outer cap.

According to the embodiment of the present invention, the content container, the discharging mechanism, the inner cap, and the operation button are lifted and lowered in a predetermined section by rotating the outer cap, and a portion thereof is drawn out or drawn in from the container body, so that the convenience in use can be facilitated, and the operation button can be prevented from being operated by external force regardless of the user's intention while being carried or stored.

According to the embodiment of the present invention, the entire cosmetic case can be prevented from being discarded when the contents stored in the content container are exhausted, only the content container combined with the discharging mechanism, the inner cap and the operation button can be replaced from the container body, so that the user's financial burden can be reduced, and waste of resources and pollution of the environment can be reduced.

According to the embodiment of the present invention, the content container, the discharging mechanism, the inner cap, and the operation button lifted and lowered together from the container body may be easily separated after pulled out from the container body, and may be easily fastened after pushed into the inner space of the container body, so that the refill operation can proceed more smoothly.

DETAILED DESCRIPTION OF THE INVENTION

Figure 1:
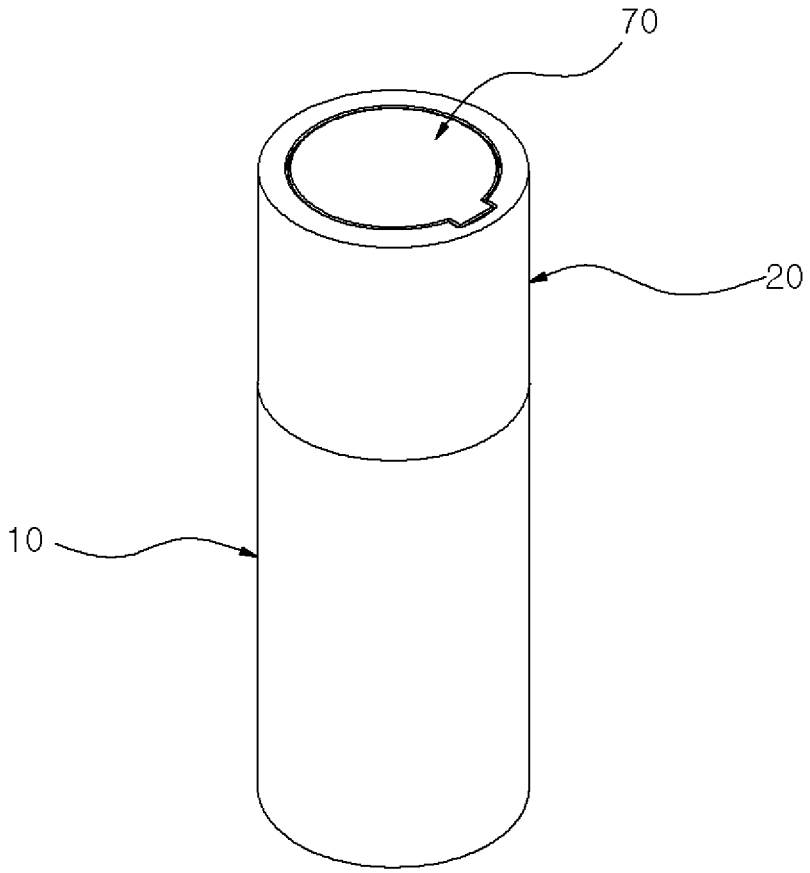
FIG. 1 is a perspective view showing a cosmetic case according to the embodiment of the present invention.

Hereinafter, the detailed descriptions of the present invention are embodiments for carrying out the present invention, and the corresponding embodiment refers to the accompanying drawings as an example. The embodiments will be described in detail to enable those skilled in the art to carry out the present invention. It is apparent to be understood that the various embodiments of the present invention may be different from each other but do not need to be mutually exclusive. For example, the particular shape, structure, and feature described herein may be embodied in other embodiments without departing from the idea and scope of the present invention in connection with the embodiment. In addition, it will be understood that the location or arrangement of an individual element within each disclosed embodiment may be modified without departing from the idea and scope of the present invention.

Accordingly, the following detailed description is not intended to disclose a limited meaning, and the scope of the invention is limited only by the appended claims, along with the full scope of equivalents to which the claims are entitled, if properly explained. Similar reference numerals in the drawings refer to the same or similar function throughout several aspects.

General term which is widely used recently has been selected in the present invention in consideration of the function according to the present invention as possible, however, the term may vary depending on the intention of those skilled in the art, judicial cases, the advent of new technology, or the like. In addition, in certain cases, the term may be arbitrarily selected by the applicant, and in this case, the meaning thereof will be described in detail in the relevant description of the invention. Therefore, the term used in the present invention should be defined based on the meaning of the term and contents throughout the present invention, not simply on the name of the term.

When one part "includes" one element in the present invention, the above expression does not exclude other elements, but may further include the other elements, unless particularly stated otherwise.

Hereinafter, a cosmetic case having a refill structure according to the embodiment of the present invention will be described in detail with reference to the accompanying drawings.

Figure 2:
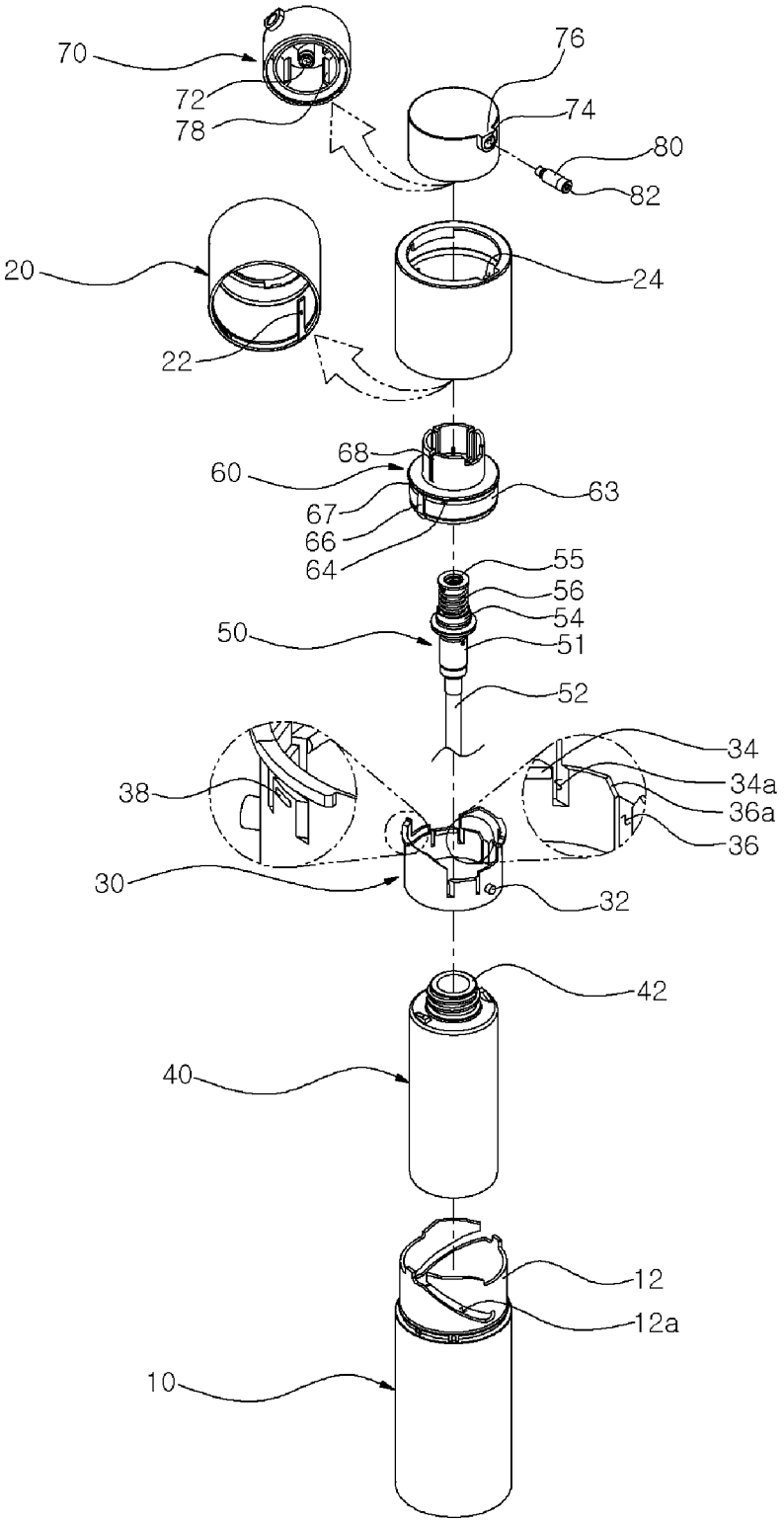
FIG. 2 is an exploded perspective view showing the cosmetic case according to the embodiment of the present invention.
Figure 3:
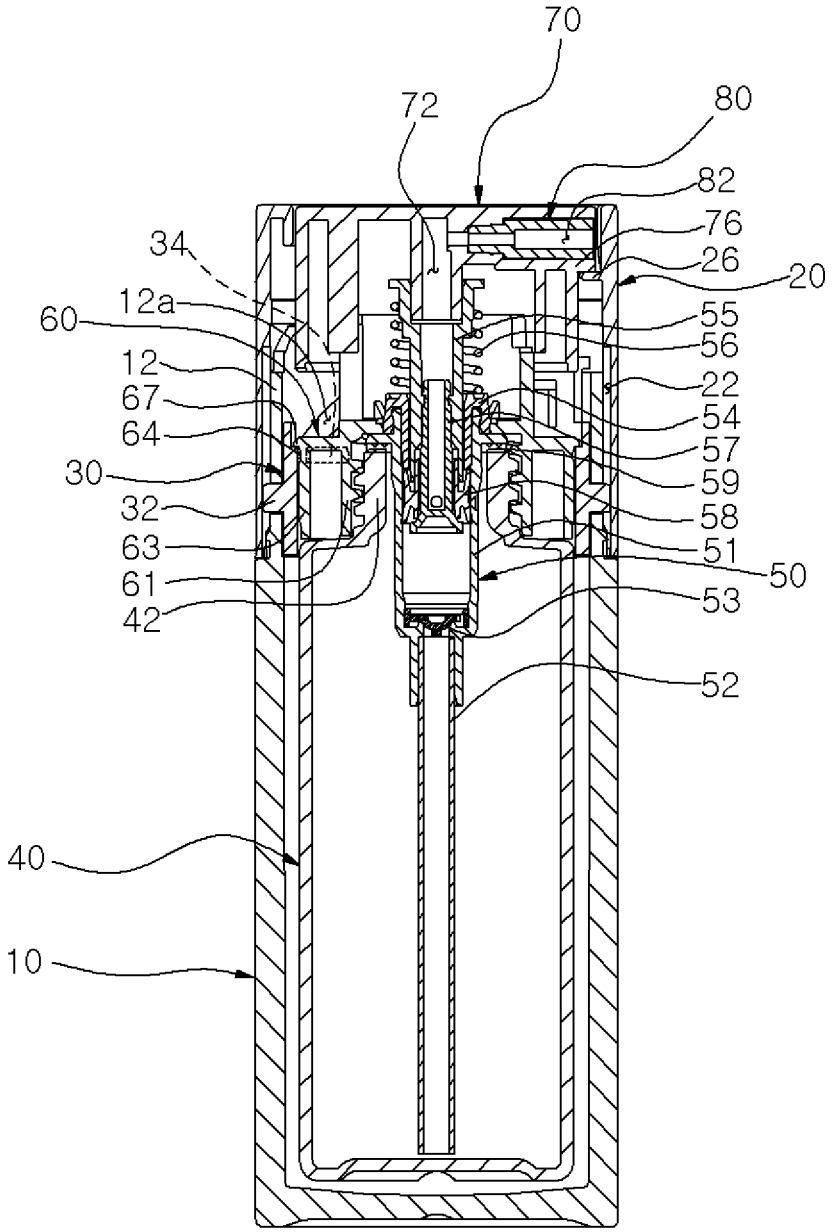
FIG. 3 is a sectional view showing the cosmetic case according to the embodiment of the present invention.

FIG. 1 is a perspective view showing a cosmetic case according to the embodiment of the present invention. FIG. 2 is an exploded perspective view showing the cosmetic case according to the embodiment of the present invention. FIG. 3 is a sectional view showing the cosmetic case according to the embodiment of the present invention.

As shown in the drawings, the cosmetic case having a refill structure according to the embodiment of the present invention may include a container body 10, an outer cap 20, an elevation mechanism 30, a content container 40, a discharging mechanism 50, an inner cap 60 and an operation button 70.

Each component of the cosmetic case having a refill structure according to the embodiment of the present invention will be described as follows.

The container body 10 has a rigid cylindrical shape with one side open, and defines an outer appearance of a container of the cosmetic case together with an outer cap 20. The container body 10 is not limited to the rigid cylinder, and may be formed in various shapes and formed of various materials in consideration of types of contents stored therein, usability, design factors, or the like. However, it may be preferable to have a narrow width and a relatively long length so as to enable a user to easily grip the container body 10.

As shown in FIG. 2, a coupling part 12 is formed in the container body 10, in which the coupling part 12 may extend from an end of the container body 10 and be inserted into the outer cap 20. At least one pair of elevation spiral grooves 12*a* are formed in the coupling part 12 to guide upward and downward movements of the elevation mechanism 30. In other words, an elevation protrusion 32 of the elevation mechanism 30 is inserted into the elevation spiral groove 12*a*, and the elevation protrusion 32 is rotated in a predetermined section by the outer cap 20 and moved along the elevation spiral groove 12*a*, so that the elevation mechanism 30 is gradually lifted or lowered. It may be preferable that the elevation spiral groove 12*a* extends in a smooth curve having a predetermined inclination angle along an outer wall of the coupling part 12, and one end is opened to assemble the elevation protrusion 32.

In addition, the inclination angle of the elevation spiral groove 12*a* may be changed, so that the rotation section, elevation speed and convenience in use of the elevation mechanism 30 may be adjusted. For example, when the inclination angle of the elevation spiral groove 12*a* is formed relatively steeply, a rotation range of the outer cap 20 for completely elevating the elevation mechanism 30 is shortened, and accordingly, the elevation mechanism 30 may be lifted and lowered faster. On the contrary, when the inclination angle of the elevation spiral groove 12*a* is formed relatively gently, the rotation range of the outer cap 20 for completely elevating the elevation mechanism 30 becomes longer, and accordingly, the elevation mechanism 30 may be lifted and lowered slowly and naturally. Thus, the elevation spiral groove 12*a* may be formed on the outer wall of the coupling part 12 to have an appropriate inclination angle by comprehensively considering the rotation section, elevation speed, convenience in use, and the like of the elevation mechanism 30.

The outer cap 20 is rotatably coupled to one side of the container body 10, and rotated by the user to rotate the elevation mechanism 30 provided therein.

As shown in FIG. 2, the outer cap 20 has a cylindrical shape with both sides open, and may be preferable to have the same diameter as that of the container body 10 for continuity of design. The outer cap 20 has an opened side into which the coupling part 12 of the container body 10 is inserted, and in which the elevation mechanism 30, the inner cap 60 and the operation button 70 are accommodated, and the other open side through which the operation button 70 is drawn out or drawn in.

An elevation straight groove 22 is formed on an inner circumference of the outer cap 20, in which the elevation protrusion 32 passing through the elevation spiral groove 12*a* is inserted into the elevation straight groove 22, so as to rotate the elevation mechanism 30 and simultaneously guide a vertical movement of the elevation protrusion 32. It may be preferable that one pair of elevation straight grooves 22 are formed at positions facing each other to correspond to the elevation spiral groove 12*a* and the elevation protrusion 32, and are elongated in a predetermined section in a longitudinal direction of the outer cap 20.

In addition, the outer cap 20 is formed in an upper inner side thereof with an insertion space 24 into which a protrusion part 76 formed in the operation button 70 is inserted, and an press-prevention protrusion 26 is formed below the insertion space 24, to prevent the operation button 70 from being pressed from the inside of the outer cap 20 and operated.

The elevation mechanism 30 is coupled to an inside of the coupling part 12 of the container body 10, and lifted or lowered within the container body 10 and the outer cap 20 while being rotated together with the outer cap 20.

At least one pair of elevation protrusions 32 may protrude outward from the outer circumference of the elevation mechanism 30. The elevation protrusion 32 is inserted into the elevation straight groove 22 of the outer cap 20 while passing through the elevation spiral groove 12*a* of the container body 10, and moved along the elevation spiral groove 12*a* and the elevation straight groove 22 when the outer cap 20 is rotated. In other words, the elevation protrusion 32 of the elevating mechanism 30 is rotated together with the outer cap 20 by the elevation straight groove 22 of the outer cap 20, and lifted or lowered in the container body 10 by the elevation spiral groove 12*a* of the container body 10, so that the inner cap 60 and the content container 40, the discharging mechanism 50 and the operation button 70 coupled to the inner cap 60 are simultaneously moved up and down. It may be preferable that the elevation protrusions 32 are formed in a pair like the elevation straight grooves 22 and disposed on opposite sides with each other.

As shown in the partially enlarged view of FIG. 2, a fastening protrusion 34 detachably coupled to the inner cap 60 protrudes from the inner circumference of the elevation mechanism 30, in which the fastening protrusion 34 may extend by a predetermined section along the inner circumference of the elevation mechanism 30. In addition, elastic slits 34*a* for providing elasticity to the fastening protrusion 34 may be formed on both sides of the fastening protrusion 34. The elastic slit 34*a* may extend vertically for a predetermined section at both ends of the fastening protrusion 34, in which the fastening protrusion 34 is bent outward and elastically restored to the home position when the elevation mechanism 30 and the inner cap 60 are attached and detached, and accordingly, the elevation mechanism 30 and the inner cap 60 may be easily coupled or separated.

In addition, a refill guide groove 36 may be formed on the inner circumference of the elevation mechanism 30. The refill guide groove 36 may guide the separation or insertion direction of the following components, such that refill operations of the inner cap 60 and the content container 40, the discharging mechanism 50 and the operation button 70 coupled to the inner cap 60 proceed smoothly. The refill guide groove 36 is formed on the inner circumference of the elevation mechanism 30 in a straight line for in a predetermined section along the direction in which the content container 40 is inserted or separated, and it may be preferable that one end of the refill guide groove 36, that is, the end in the direction in which the inner cap 60 is separated may be opened, and the other end, that is, the end in the direction in which the inner cap 60 is inserted may be closed.

Guide oblique surfaces 36*a* may be formed on both sidewalls of the opened portion of the refill guide groove 36, to guide the refill guide protrusion 66 formed on the inner cap 60 to be correctly inserted. It may be preferable that the guide oblique surface 36*a* is inclined at a predetermined angle in an outward direction of the refill guide groove 36. In other words, the guide oblique surface 36*a* may widen an entrance width of the refill guide groove 36 to guide an insertion position of the refill guide protrusion 66, so that the refill guide protrusion 66 may be more easily inserted into the refill guide groove 36.

In addition, a friction protrusion 38 may protrude outward from an upper outer circumference of the elevation mechanism 30, and the friction protrusion 38 may come into close contact with an inner wall of the coupling part 12 of the container body 10, so as to generate a friction between the container body 10 and the elevation mechanism 30 when the elevation mechanism 30 is rotated by the outer cap 20. Accordingly, the rotational feeling may be expected to improve during the rotation operation of the outer cap 20.

The content container 40 serving as a storage member for storing liquid or gel contents therein is inserted and stored in an inner space of the container body 10.

An inlet part 42 may be formed on one side of the content container 40, the contents may be filled through the inlet part 42, and a portion of the discharging mechanism 50 described later may be inserted thereto. It may be preferable that a thread is formed on the outer circumference of the inlet part 42, so as to be screw-coupled to the thread formed on the lower inner circumference of the inner cap 60. In the cosmetic case according to the embodiment of the present invention, the content container 40 and the inner cap 60 are shown as being screw-coupled to each other. However, the present invention is not limited thereto, and may be implemented in various coupling schemes, such as coupling between protrusions and grooves, or forced fitting coupling or joining, within the range for stably fixedly coupling the content container 40 and the inner cap 60.

The discharging mechanism 50 is installed to the inlet part 42 of the content container 40 or a position adjacent to the inlet part 42, so as to discharge the contents stored in the content container 40. In other words, while being installed to the inside of the inner cap 60, the discharging mechanism 50 has one side inserted through the inlet part 42 of the content container 40 and the other side connected to the operation button 70. It may be preferable that the discharging metering pump 50 is a pump for discharging a fixed amount of contents to the outside through the pumping operation.

As shown in FIG. 3, the discharging mechanism 50 may include: a housing 51 inserted into the inlet part 42 of the content container 40 and formed in a lower portion thereof with a content suction port 51*a*; a suction tube 52 connected to the content suction port 51*a* and inserted into the content container 40; a suction valve plate 53 for opening and closing the content suction port 51*a* of the housing 51; a sealing cap 54 surrounding an upper portion of the housing 51 and coupled thereto; a stem 55 reciprocating in a pumping operation direction while passing through the sealing cap 54; an elastic spring 56 for elastically supporting the stem 55; an operation discharge pipe 57 coupled to the stem 55 and reciprocating together; and an operation discharge ring 58 fitted to an outer side of the operation discharge pipe 57 and coming into close contact with the inner circumference of the housing 51.

In addition, a sealing ring 59 may be further provided between the housing 51 of the discharging mechanism 50 and the inlet part 42 of the content container 40, so that the airtightness inside the content container 40 may be maintained. The sealing ring 59 is formed of an elastic material for further improving the sealing force of the content container 40, may be preferable to be formed of at least one material of urethane rubber, natural rubber, elastomer, nitrile-butadiene rubber (NBR), and silicone, or polypropylene, polyethylene, or acrylonitrile butadiene styrene (ABS) having elasticity material, and particularly, may be most desirable to be formed of thermo plastic elastomer (TPE) as a material between rubber and plastic with softness and excellent durability.

The inner cap 60 is coupled to the inlet part 42 of the content container 40, and ascends or descends together with the elevation mechanism 30 while being fastened to the elevation mechanism 30, in which the discharging mechanism 50 may be installed while passing through a center of the inner cap 60. A lower inner wall 61 may extend downward from the inner cap 60, and a lower outer wall 63 may extend downward while being spaced apart at a predetermined interval from an outer side of the lower inner wall 61, and a thread may be formed on an inner circumference of the lower outer wall 63 so as to be screw-coupled to the thread formed in the inlet part 42 of the content container 40.

As shown in FIG. 2, a fastening groove 64 detachably coupled to the elevation mechanism 30 is formed on the outer circumference of the inner cap 60, in which the fastening protrusion 34 of the elevation mechanism 30 may be coupled to the fastening groove 64. The fastening groove 64 may extend entirely along the outer circumference of the inner cap 60.

In addition, a refill guide protrusion 66 is formed on the outer circumference of the inner cap 60, in which the refill guide protrusion 66 may be inserted into the refill guide groove 36 of the elevation mechanism 30. The refill guide protrusion 66 may be formed on the outer circumference of the inner cap 60 in a straight line for a predetermined section along the direction in which the content container 40 is inserted or separated, and may be disposed below the fastening groove 64 so as to allow the refill guide protrusion 66 to be inserted into the refill guide groove 36, and sequentially fasten the fastening groove 66 and the fastening protrusion 34.

In addition, as shown in FIG. 3, a locking jaw 67 may protrude outward from the upper portion of the fastening groove 64 of the inner cap 60, so that the inner cap 60 may be prevented from be separated into the container body 10. At least one guide straight hole 68 may be formed in the upper portion of the inner cap 60, so that linear reciprocating movements of the operation button 70 may be guided. It may be preferable that the guide straight hole 68 extends for a predetermined section along the moving direction of the operation button 70.

The operation button 70 is coupled to the discharging mechanism 50 to discharge the contents stored in the content container 40 to the outside while being vertically reciprocated by the user's pressure operation.

A discharge passage 72 may be formed in a center of the operation button 70 so as to be connected to the discharging mechanism 50.

A nozzle coupling hole 74 may be formed on one side of the discharge passage 72, and a nozzle 80 having a discharge port 82 may be coupled to the nozzle coupling hole 74. It may be preferable that the nozzle 80 is completely inserted into the nozzle coupling hole 74.

In addition, the protrusion part 76 may protrude outward from the outer circumference of the operation button 70. When the operation button 70 is drawn into the outer cap 20, the protrusion part 76 is inserted into the insertion space 24 of the outer cap 20, and seated on an upper end of a press-prevention step 26 to restrict the press of the operation button 70. Accordingly, during storing or carrying the cosmetic case, the operation button 70 inserted into the outer cap 20 may be prevented from being pressed and malfunctioned by the external force.

In addition, at least one guide straight protrusion 78 may protrude from the inner circumference of the operation button 70 so as to be inserted into the guide straight hole 68 of the inner cap 60. It may be preferable that the guide straight protrusion 78, like the guide straight hole 68 of the inner cap 60, extends for a predetermined section along the moving direction of the operation button 70.

As described above, according to the cosmetic case of the embodiment of the present invention, the content container, the discharging mechanism, the inner cap, and the operation button are lifted and lowered in a predetermined section by rotating the outer cap, and a portion thereof is drawn out or drawn in from the container body, so that the convenience in use can be facilitated, the operation button can be prevented from being operated by external force regardless of the user's intention while being carried or stored, the entire cosmetic case can be prevented from being discarded when the contents stored in the content container are exhausted, and only the content container combined with the discharging mechanism, the inner cap and the operation button can be replaced from the container body. Thus, the user's financial burden can be reduced, and waste of resources and pollution of the environment can be reduced. Further, according to the cosmetic case of the embodiment of the present invention, the content container, the discharging mechanism, the inner cap, and the operation button lifted and lowered together from the container body may be easily separated after pulled out from the container body, and may be easily fastened after pushed into the inner space of the container body, so that the refill operation can proceed more smoothly.

FIGS. 4 to 9 are drawings illustrating the use and refilling of the cosmetic case having a refill structure according to the embodiment of the present invention. The method for using and refilling the cosmetic case having a refill structure according to the embodiment of the present invention will be described with reference to the above drawings.

Figure 4:
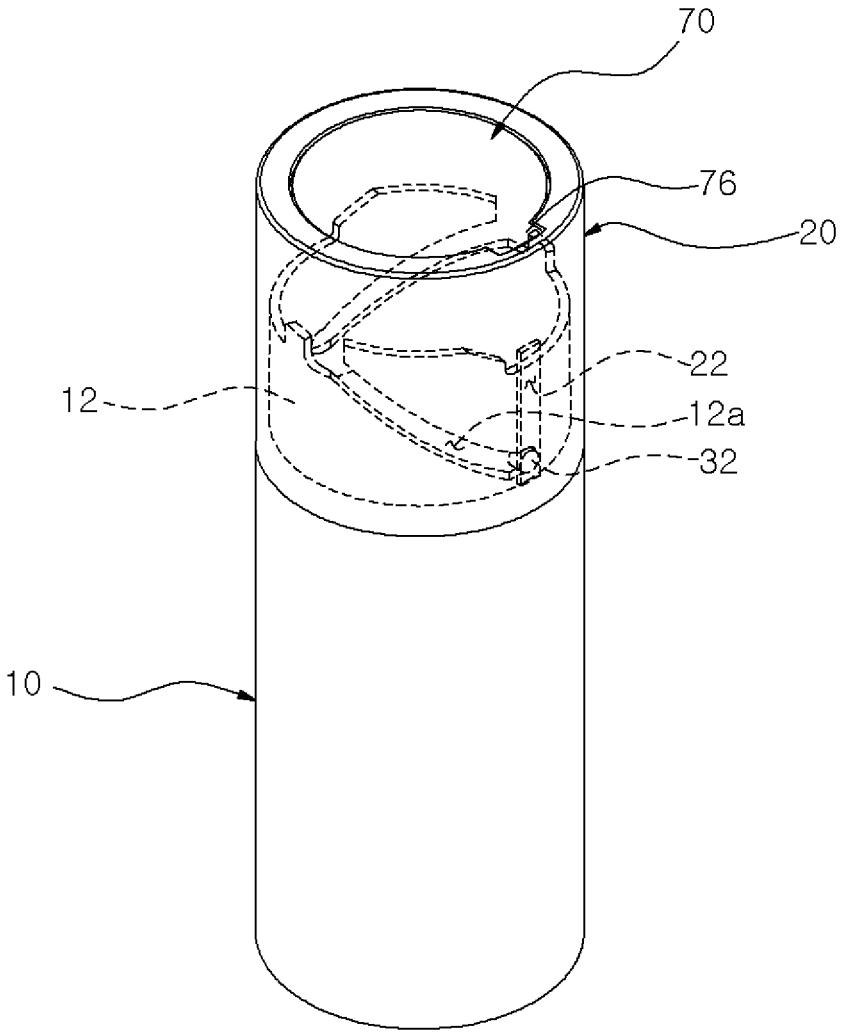
FIG. 4 is a perspective view illustrating a state in which an operation button is drawn into an outer cap according to the embodiment of the present invention.
Figure 5:
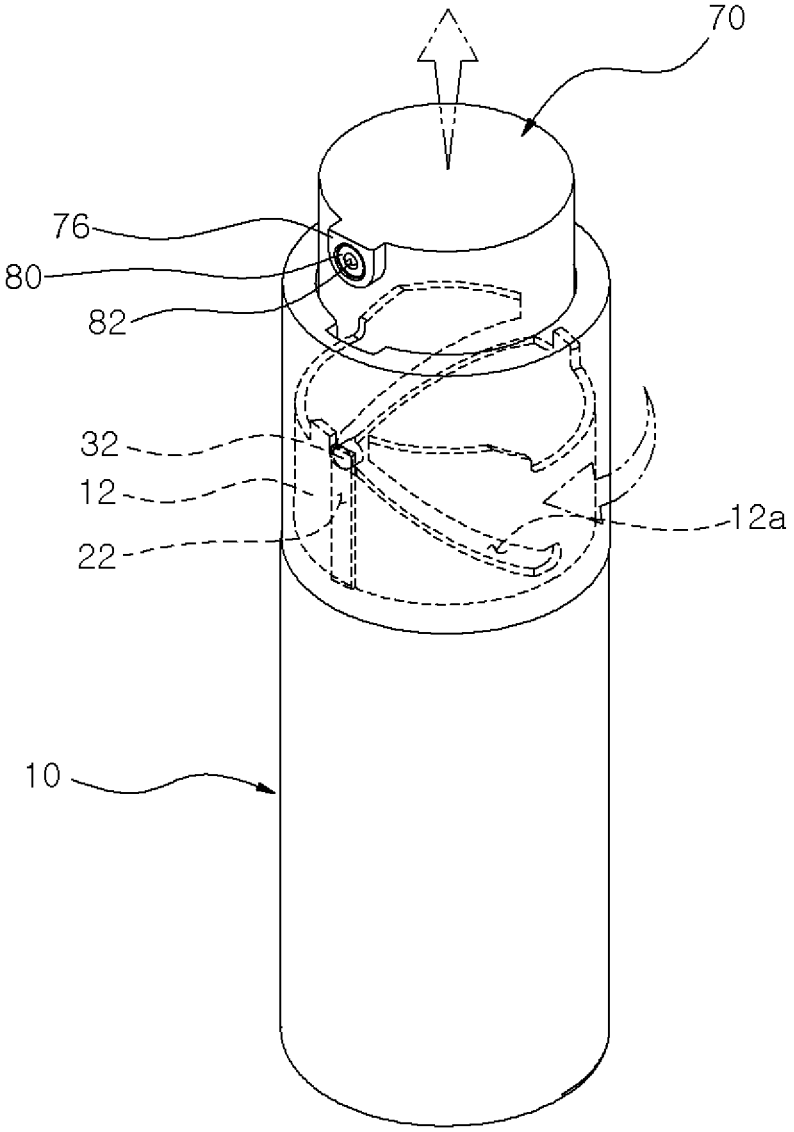
FIG. 5 is a perspective view illustrating a state in which the operation button is drawn out of the outer cap according to the embodiment of the present invention.
Figure 6:
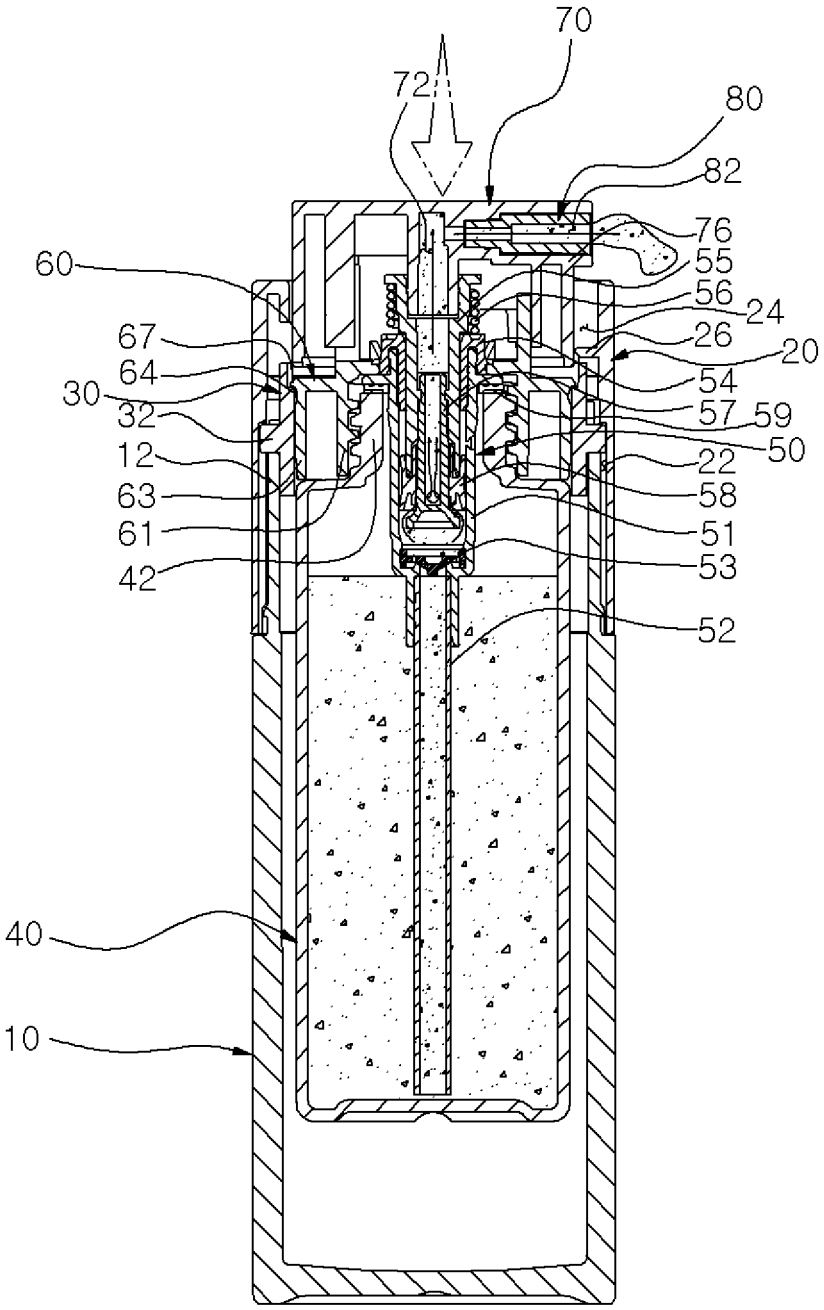
FIG. 6 is a sectional view illustrating a state in which the operation button is pressed according to the embodiment of the present invention.
Figure 7:
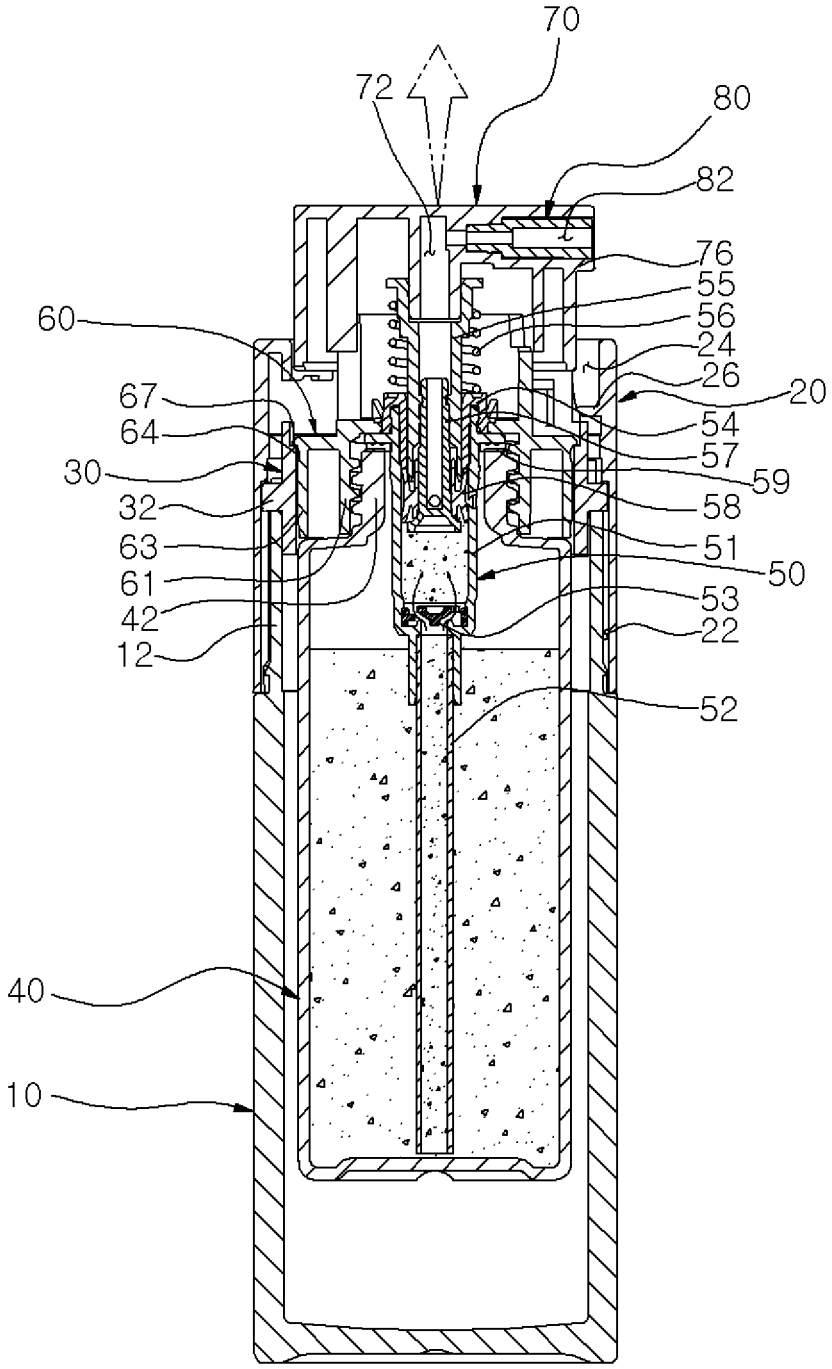
FIG. 7 is a sectional view illustrating a state in which the pressurization of the operation button is released according to the embodiment of the present invention.
Figure 8:
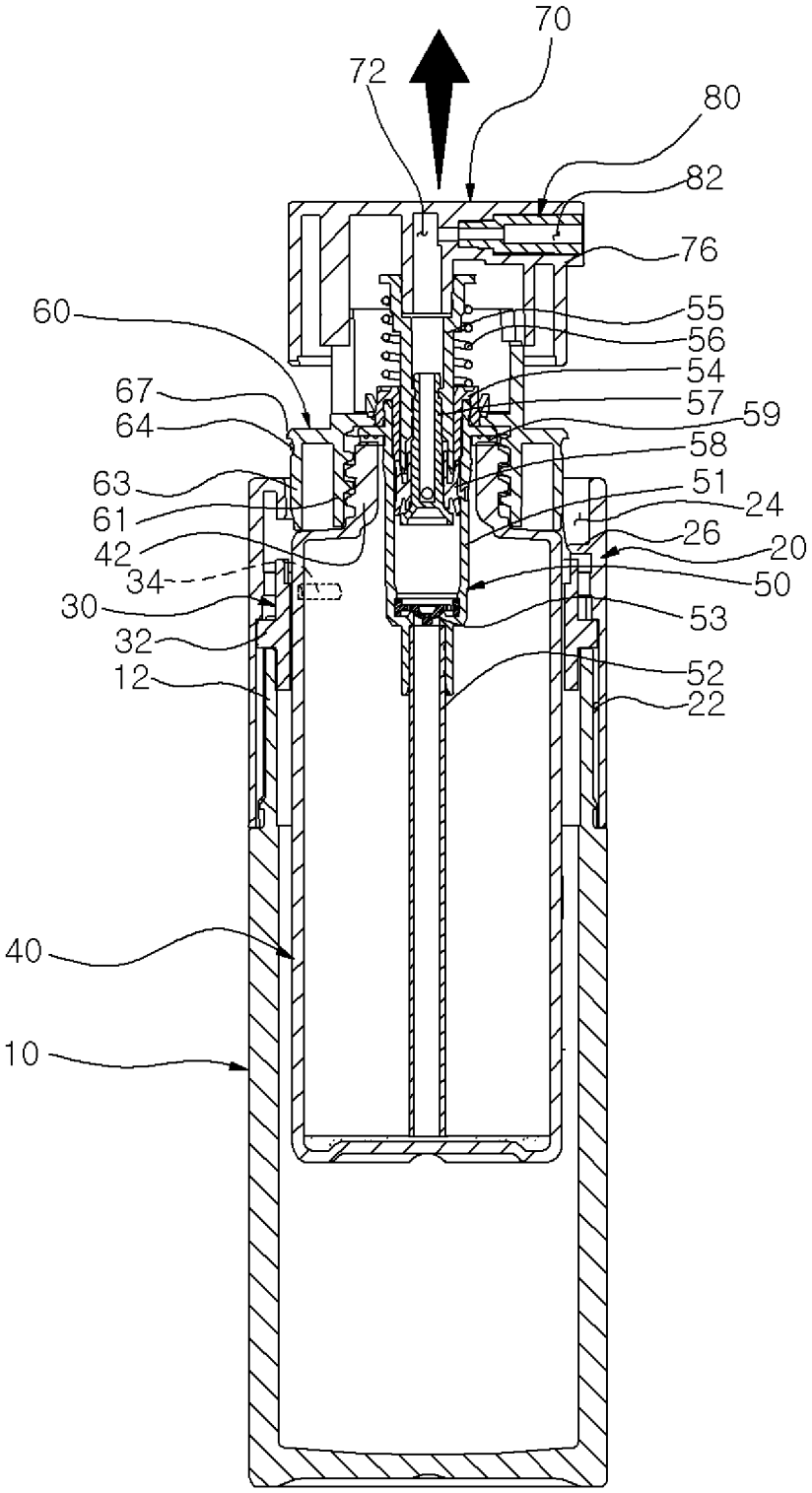
FIG. 8 is a sectional view illustrating a state in which a content container, a discharging mechanism, and an operation button are separated from the container body and the outer cap according to the embodiment of the present invention.
Figure 9:
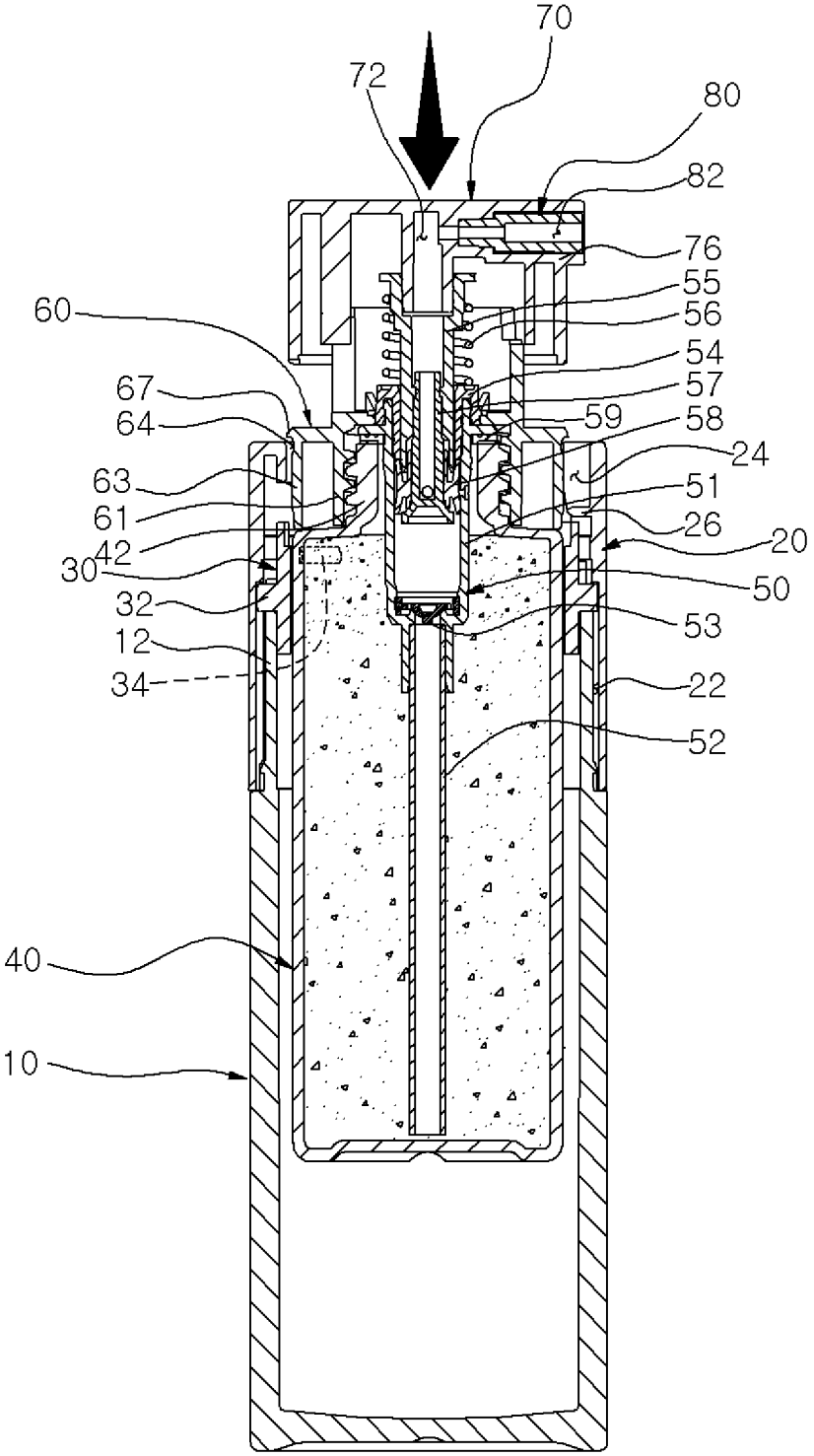
FIG. 9 is a sectional view illustrating a state in which the content container, the discharging mechanism, and the operation button are inserted into the inner spaces of the container body and the outer cap according to the embodiment of the present invention.

FIG. 4 is a perspective view illustrating a state in which the operation button is drawn into the outer cap according to the embodiments of the present invention. FIG. 5 is a perspective view illustrating a state in which the operation button is drawn out of the outer cap according to the embodiments of the present invention. FIG. 6 is a sectional view illustrating a state in which the operation button is pressed according to the embodiments of the present invention. FIG. 7 according to the embodiments of the present invention, is a sectional view illustrating a state in which the pressurization of the operation button is released. FIG. 8 is a sectional view illustrating a state in which the content container, the discharging mechanism, and the operation button are separated from the container body and the outer cap according to the embodiments of the present invention. FIG. 9 is a sectional view illustrating a state in which the content container, the discharging mechanism, and the operation button are inserted into the inner spaces of the container body and the outer cap according to the embodiments of the present invention.

In order to use the cosmetic case having a refill structure according to the present invention, the container body 10 is held and the outer cap 20 is rotated in one direction.

As shown in FIG. 5, when the outer cap 20 is rotated with respect to the container body 10, the elevating protrusion 32 of the elevation mechanism 30 inserted into the elevation straight groove 22 of the outer cap 20 is rotated together with the outer cap 20 and the elevation protrusion 32 is simultaneously moved upward along the elevation spiral groove 12*a* of the container body 10. As the inner cap 60 fastened to the elevation mechanism 30 and the content container 40, discharging mechanism 50 and operation button 70 coupled to the inner cap 60 gradually ascend, the operation button 70 is drawn outward from the outer cap 20. The elevation protrusion 32 of the elevation mechanism 30 is moved in a straight line within the elevation straight groove 22 of the outer cap 20.

Thereafter, as shown in FIG. 6, when the discharging mechanism 50 coupled to the operation button 70 is pressurized by pressing the operation button 70 exposed to the outside, the stem 55 of the discharging mechanism 50 and the operation discharge pipe 57 coupled to the lower portion of the stem 55 are moved downward together. Since the operation discharge ring 58 comes into close contact with the inner surface of the housing 51, only the operation discharge pipe 57 is moved downward, and accordingly a gap is generated between the operation discharge pipe 57 and the operation discharge ring 58, thereby generating a passage for the contents.

Thereafter, when the operation button 70 is continuously pressed, the lower end of the stem 55 moved downward by the operation button 70 presses the operation discharge ring 58, so that the operation discharge ring 58 is moved downward together with the operation discharge pipe 57, thereby reducing the volume inside the housing 51. Accordingly, the suction valve plate 53 closes the content suction port 51*a* due to the discharging pressure in the housing 51, and the contents accommodated in the housing 51 simultaneously come out between the operation discharge pipe 57 and the operation discharge ring 58, pass through an inlet passage formed in a center of the operation discharge pipe 57, and are discharged to the discharge port 82 of the nozzle 80 via the discharge passage 72 of the operation button 70.

Thereafter, as shown in FIG. 7, when the pressure of the operation button 70 is released, the elastic spring 56 elastically supporting the stem 55 of the discharging mechanism 50 is restored to the original shape, so that the stem 55 is moved upward, and the operation discharge pipe 57 coupled to the lower side of the stem 55 is also moved upward. The lower portion of the operation discharge pipe 57 pulls the operation discharge ring 58 upward and the gap between the operation discharge pipe 57 and the operation discharge ring 58 is blocked, so that the operation discharge pipe 57 and the operation discharge ring 58 are moved upward together, and accordingly, the volume inside the housing 51 is increased, thereby generating the vacuum pressure.

Thereafter, the suction valve plate 53 is lifted by the vacuum pressure generated inside the housing 51, and accordingly, the content suction port 51*a* formed on the bottom surface of the housing 51 is opened, so that the contents accommodated in the inner container 20 are introduced into the housing 51 through the suction tube 52.

After the makeup is completed, the operation button 70 is inserted into the outer cap 20 so as to be stored or carried. When the outer cap 20 is rotated in the opposite direction, the elevation protrusion 32 of the elevation mechanism 30 inserted into the elevation straight groove 22 of the outer cap 20 is rotated together with the outer cap 20 and the elevation protrusion 32 is simultaneously moved downward along the elevation spiral groove 12*a* of the container body 10. As the inner cap 60 fastened to the elevation mechanism 30 and the content container 40, discharging mechanism 50 and operation button 70 coupled to the inner cap 60 gradually descend, the operation button 70 is drawn into the outer cap 20 as shown in FIG. 4. The elevation protrusion 32 of the elevation mechanism 30 is moved in a straight line within the elevation straight groove 22 of the outer cap 20.

In addition, when the contents accommodated in the content container 40 are entirely used, the content container 40 may be replaced and used. As shown in FIG. 8, when the outer cap 20 is rotated with respect to the container body 10 to draw out the operation button 70 outward from the outer cap 20, and the operation button 70 is pulled from the container body 10, the inner cap 60 is pulled together with the operation button 70, and the fastening between the fastening protrusion 34 formed in the elevation mechanism 30 and the fastening groove 64 formed in the inner cap 60 are simultaneously released, so that the elevation mechanism 30 and the inner cap 60 are separated, and continuously, the inner cap 60 and the content container 40, discharging mechanism 50 and operation button 70 coupled to the inner cap 60 come out together from the container body 10 and the outer cap 20. As shown in FIG. 9, the discharging mechanism 50, inner cap 60 and operation button 70 coupled to a new content container 40 are inserted into the container body 10 while being inserted into the opened portion of the outer cap 20. The refill guide protrusion 66 of the inner cap 60 is guided to the correct position by the guide oblique surface 36*a* of the elevation mechanism 30, and inserted into the refill guide groove 36, so that the refill operation proceeds smoothly.

Although the invention has been described with the particulars such as specific elements, the limited embodiments, and the drawings, the above description is provided only to help comprehensive understanding of the present invention, and the present invention is not limited to the embodiments. It is obvious to those skilled in the art that various changes and modifications may are available. Therefore, the spirit of the present invention should not be limited to the aforementioned embodiments, and the following claims as well as all modifications or variations belonging to the equivalents of the claims will be within the scope of the invention.

What is claimed is:

1. A cosmetic case having a refill structure, the cosmetic case comprising:

a container body having one opened side and formed therein with an elevation spiral groove;

an outer cap rotatably coupled to the container body in a predetermined section and formed therein with an elevation straight groove;

an elevation mechanism lifted and lowered in the container body while being rotated together with the outer cap, and formed therein with an elevation protrusion;

a content container accommodated inside the container body to store contents therein;

a discharging mechanism installed in the content container to discharge the contents;

an inner cap coupled to one side of the content container, and lifted and lowered together with the elevation mechanism; and an operation button connected to the discharging mechanism to discharge the contents to an outside, wherein the elevation mechanism and the inner cap are formed therein with a fastening protrusion and a fastening groove, respectively, so as to be detachably coupled to each other, and formed therein with a refill guide groove and a refill guide protrusion, respectively, so that the refill guide protrusion is inserted into the refill guide groove.

2. The cosmetic case of claim 1, wherein the container body is formed therein with a coupling part, in which the coupling part extends from an end of the container body and is inserted into the outer cap, and the coupling part is formed therein with at least one pair of elevation spiral grooves.

3. The cosmetic case of claim 1, wherein the fastening protrusion extends by a predetermined section along an inner circumference of the elevation mechanism, and the fastening groove extends along an outer circumference of the inner cap.

4. The cosmetic case of claim 3, wherein the fastening protrusion is formed on both sides thereof with elastic slits for providing elasticity to the fastening protrusion.

5. The cosmetic case of claim 1, wherein the refill guide groove and the refill guide protrusion are formed on an inner circumference of the elevation mechanism and an outer circumference of the inner cap, respectively, in a straight line along a direction in which the content container is inserted or separated.

6. The cosmetic case of claim 1, wherein one end of the refill guide groove is opened, and guide oblique surfaces for guiding the refill guide protrusion to be inserted are formed on both sidewalls of the opened portion.

7. The cosmetic case of claim 6, wherein the guide oblique surface is inclined at a predetermined angle in an outward direction of the refill guide groove.

8. The cosmetic case of claim 1, wherein the elevation mechanism is formed on an outer circumference thereof with a friction protrusion, to generate friction between the elevation mechanism and the container body while coming into close contact with an inner circumference of the container body.

9. The cosmetic case of claim 1, wherein the content container is formed therein with an inlet part, in which the inlet part is screw-coupled to the inner cap.

10. The cosmetic case of claim 1, wherein the discharging mechanism includes a pump for discharging the contents by pumping.

11. The cosmetic case of claim 1, wherein the inner cap is formed therein with a guide straight hole, and the operation button is formed therein with a guide straight protrusion, so as to be fastened to each other.

12. The cosmetic case of claim 1, wherein the operation button is formed therein with a nozzle coupling hole, in which a nozzle having a discharge port is coupled to the nozzle coupling hole.

13. The cosmetic case of claim 1, wherein the operation button is formed thereon with a protrusion part, and the outer cap is formed thereon with a press-prevention step, so that the protrusion part is seated on an upper end of the press-prevention step when the operation button is inserted into the outer cap.

14. The cosmetic case of claim 1, wherein the content container, the discharging mechanism, the inner cap and the operation button are simultaneously separated from the container body and the outer cap, or inserted into inner spaces of the container body and the outer cap.

* * * * *